United States Patent [19]

Bergeron

[11] Patent Number: 5,025,918

[45] Date of Patent: Jun. 25, 1991

[54] SHOWCASE FOR STORING AND DISPLAYING POST-TYPE EARRINGS

[76] Inventor: Margaret Bergeron, 12298 Sawgrass Ct., West Palm Beach, Fla. 33414

[21] Appl. No.: 506,840

[22] Filed: Apr. 9, 1990

Related U.S. Application Data

[63] Continuation-in-part of Ser. No. 405,240, Sep. 11, 1989.

[51] Int. Cl.[5] ..... B65D 73/00; B65D 85/00

[52] U.S. Cl. ..... 206/45.14; 206/6.1; 206/495; 383/39

[58] Field of Search ..... 206/6.1, 495, 486, 488, 206/489, 466, 472, 475, 45.14; 383/38, 39, 40; 150/110

[56] References Cited

U.S. PATENT DOCUMENTS

| | | | |
|---|---|---|---|
| 1,426,485 | 8/1922 | La Roche | 383/40 X |
| 3,900,060 | 8/1975 | Shammas | 206/6.1 X |
| 4,580,667 | 4/1986 | Herwood . | |
| 4,720,012 | 1/1988 | Dufour | 206/495 X |
| 4,760,920 | 8/1988 | Thomsen | 206/495 |
| 4,821,883 | 4/1989 | Miller | 206/495 |
| 4,859,084 | 8/1989 | Kaumeyer . | |
| 4,930,635 | 6/1990 | Hotchkiss et al. . | |

OTHER PUBLICATIONS

Merchandise Catalog—p. 19—"Satin Jewelry Roll".

*Primary Examiner*—Jimmy G. Foster
*Assistant Examiner*—Jacob K. Ackun, Jr.
*Attorney, Agent, or Firm*—Eckert Seamans Cherin & Mellott

[57] ABSTRACT

A showcase includes a flexible cover sheet, a flexible mounting sheet having a plurality of holes therein, and a flexible spacer sheet, all bound together along folds. A hanger strap is attached at its ends adjacent to top corners of the cover sheet. A first closure pair, attached adjacent to the top edges of the cover sheet and mounting sheet, normally holds them together. Second and a third closure pairs, attached adjacent to the top and bottom corners on each side of the cover sheet, hold the showcase together in the transport mode, but can be easily opened to convert the showcase to the display mode.

6 Claims, 2 Drawing Sheets

Fig. 1.
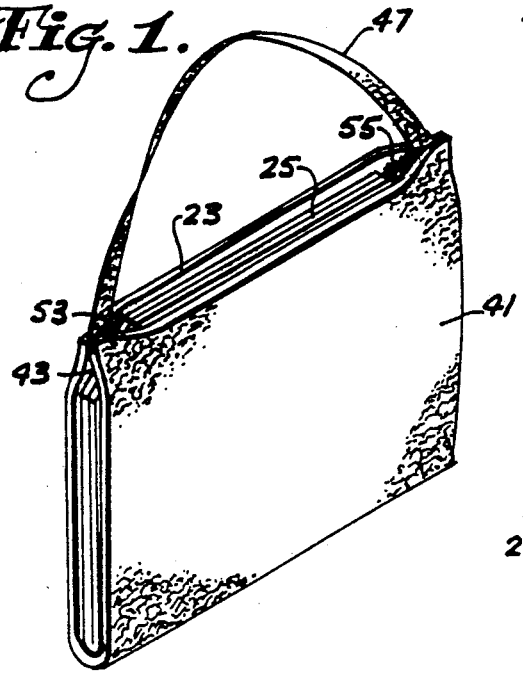
Fig. 2.
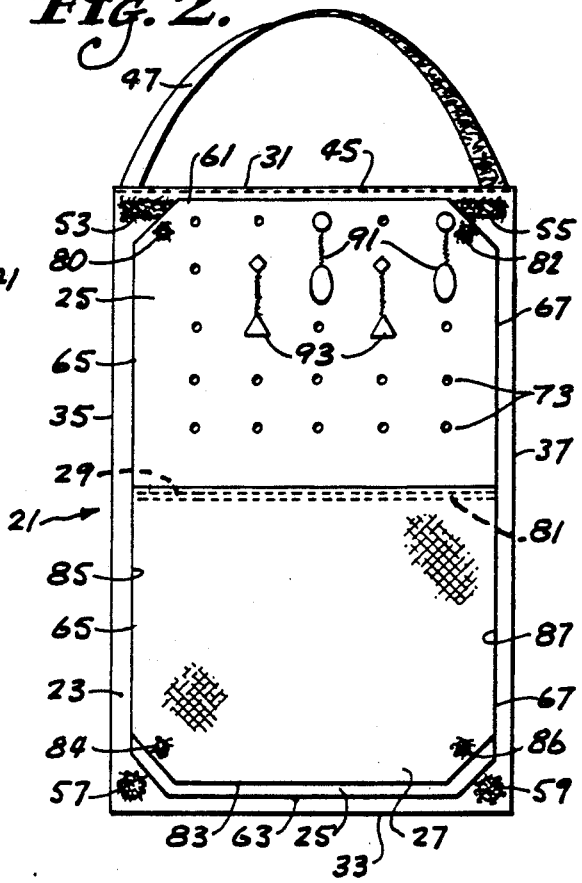
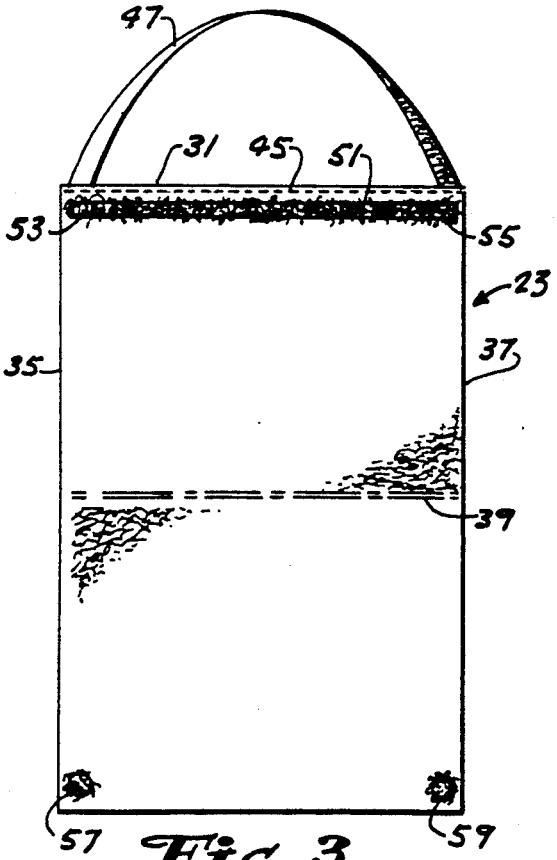
Fig. 3.
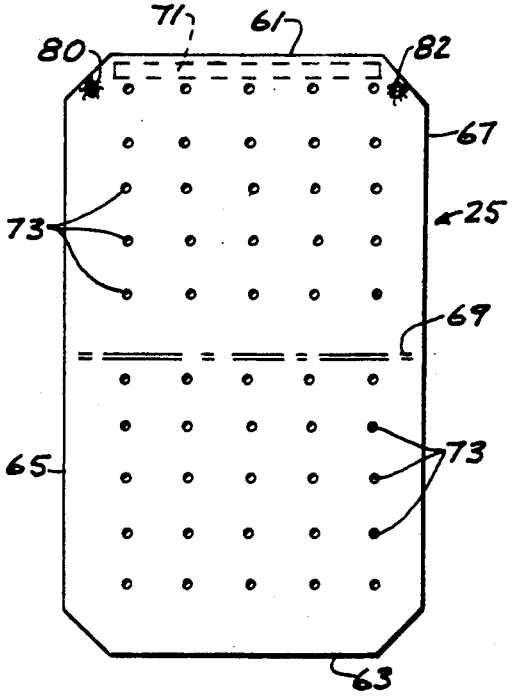
Fig. 4.

SHOWCASE FOR STORING AND DISPLAYING POST-TYPE EARRINGS

CROSS REFERENCE TO RELATED APPLICATION

This application is a continuation-in-part of pending application Ser. No. 405,240, filed Sept. 11, 1989.

BACKGROUND OF THE INVENTION

1. Field of the Invention

This invention relates to a showcase for storing and displaying post-type earrings. The novel showcase is designed for travelers whereby it is easily converted from the closed storage-and-transport mode to the open hanging-display mode. The novel showcase is especially useful for receiving large, dangling earrings therein.

2. Description of the Prior Art

Earrings are common adornments worn by men and women on their persons. One type that is in common use is the post-type earring, which is used by persons with pierced ear lobes. A post-type earring includes a decorative portion which is supported on a post, which post is inserted in the ear lobe of the wearer. A dangling-type earring includes a decorative portion that is large relative to the ear lobe, and dangles loosely below the post.

As a result of the attractiveness of wearing dangling earrings, many people, especially women, have acquired fairly large collections of post-type earrings in matched pairs for use in combination with particular outfits of attire. When going on a trip, earring wearers take along a plurality of matched pairs of earrings to be worn on different occasions during the trip. It is not satisfactory to place these earrings, especially dangling earrings, loosely in a bag or purse, because they may become scratched, broken, bent or stuck together while they are being transported in the wearer's baggage. Also where many matched pairs are mixed together, a particular pair may be difficult to find. Several solutions to this problem have been proposed.

U.S. Pat. No. 4,465,179 to B. A. Miller discloses a zippered purse having an attached tab in which post-type earrings can be mounted. Because of its size, only a few small earrings can be mounted on the tab. Also, the tab is not adapted for mounting dangling earrings.

U.S. Pat. No. 4,720,012 to H. Dufour discloses a jewelry holder in the form of a loose-leaf notebook. The holder includes a ring binder with padded front and back covers, two mesh pages on which post-type earrings can be mounted, and a cushioned separator page between the mesh pages. The pages are holed and are held on the rings of the binder by the holes therein. The binder is provided with a tab having a Velcro closure pair for releasably holding the binder covers together. While this holder can accommodate large, dangling earrings, it is not adapted for a modern traveler's needs. The stiff binder cover and pages therein result in a bulky, relatively heavy mass that is not suitable for modern travel. Also the holder is not adapted to be hung, as on a wall or from a coat hanger.

U.S. Pat. No. 4,821,883 to K. M. Miller discloses a foldable jewelry holder comprising a flexible rectangular sheet of mesh-type material bonded to a sheet of craft foam. A stiff wire is sewn along one minor edge of the composite sheet so that the composite sheet can be rolled up from the one minor edge and tied together with the cords attached near the other minor edge. While this jewelry holder is flexible, is adapted by its flexibility and weight for modern travel, is not bulky and is able to be hanged, it is not adapted for storing and displaying large and dangling earrings.

SUMMARY OF THE DISCLOSURE

An object of this invention is to provide a novel showcase for storing and displaying large, dangling post-type earrings.

A further object is to provide a novel showcase which is not bulky, can be hung, and is easily converted from the closed storage and transport mode to the open, hanging-display mode.

Another object is to provide a novel showcase which is flexible, relatively light in weight and is otherwise adapted for a modern traveler's needs.

The foregoing and other objects may be achieved with the novel showcase comprising a flexible cover sheet; a flexible, perforated mounting sheet, and a flexible spacer sheet. The cover sheet, mounting sheet and spacer sheet have folds about half-way between, and substantially parallel, to the top and bottom edges thereof. The spacer sheet, which is shorter than the other sheets, may be of padded or substantially impervious material to protect the facing jewelry items from scratching each other, or alternatively, it may be of two layers with a plurality of compartments formed by stitching the two layers in various configurations.

The folds in the spacer sheet, the mounting sheet and the cover sheet are superimposed on one another in that order and are bound together along the superimposed folds. A stiffener, which may be a metal wire of a stiff fabric, can be provided and is integral with and adjacent to the top edge of the cover sheet. Also, a flexible hanger can be attached at ends thereof adjacent to the corners of the cover sheet at the top edge of the cover sheet.

The novel showcase includes closure means near the top and bottom edges of the cover and the mounting sheet. Preferably the mounting sheet has cut-away corners at its top and bottom edges to expose the closure means on the top cover sheet edge to the closure means on the bottom cover sheet edge.

In the transport mode, the novel showcase is folded with the top and bottom edges of the cover sheet held together by closure means. The strap may be used for carrying, like a ladies handbag, if desired. When the novel showcase is carried by the strap in the transport mode, the fold in the cover sheet is downward, thereby preventing any of the contents from dropping out of the edges thereof.

The novel showcase is easily converted from the transport mode to the display mode by manually pulling apart the closure means, and supporting the novel showcase by the strap. The bottom edges of the cover sheet, the mounting sheet and both edges of the spacer sheet hang downward from the stitching; the top edge of the mounting sheet is held to the top edge of the cover sheet by closure means; and the top edge of the cover sheet is held flat by the stiffness of the stiffener.

Earrings may be mounted on or removed from the top portion of the mounting sheet by manually pulling apart the closure means, making the change, and then reclosing. Earrings may be mounted on or removed from the bottom portion of the mounting sheet by manually raising the spacer sheet, making the change, and then allowing the spacer sheet to hang down. The posts of the earrings are mounted in the perforations in the mounting sheet. The novel showcase may be returned to the transport mode by connecting the closure means on the top and bottom edges of the cover sheet.

Thus, there is provided a novel showcase which can achieve each of the above-stated objects. In some preferred forms of the invention, the cover sheet has a composite structure including a decorative outer layer and a puncture-resistant inner protective layer adjacent to the mounting sheet. In other preferred forms of the invention, the cover sheet extends beyond and overlaps the mounting and spacer sheets. Also, in some forms of the invention, one closure portion of the closure means is a closure strip attached to the cover sheet extending substantially the entire cover sheet width adjacent to the top edge thereof.

BRIEF DESCRIPTION OF THE DRAWINGS

There are shown in the drawings embodiments which are presently preferred, it being understood, however, that the invention is not limited to the precise arrangements and instrumentalities shown, wherein:

FIG. 1 is a perspective view of a preferred embodiment of the novel showcase in the transport mode.

FIG. 2 is an elevational view of the embodiment shown in FIG. 1 in the display mode.

FIG. 3 is a plan view of the cover sheet before assembly.

FIG. 4 is a plan view of the mounting sheet before assembly.

DETAILED DESCRIPTION OF THE PREFERRED EMBODIMENTS

Figure 5:
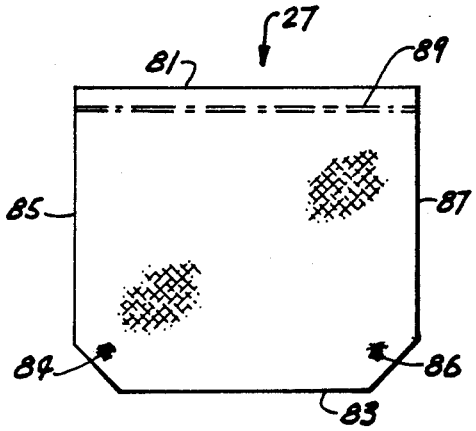
FIG. 5 is a plan view of the spacer sheet before assembly.
Figure 6:
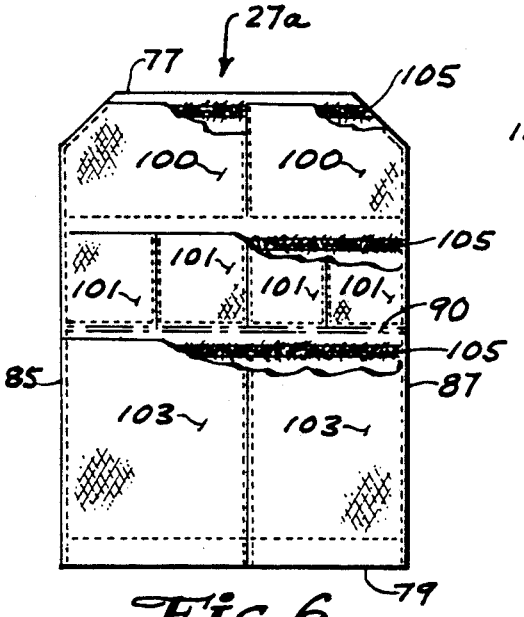
FIG. 6 is a plan view of an alternative compartmentalized spacer sheet before assembly.

Referring now to the drawings, the novel showcase 21 comprises a flexible, rectangular cover sheet 23, a flexible, substantially-rectangular mounting sheet 25, and a flexible, substantially-rectangular spacer sheet 27, all bound together preferably with stitching 29. The cover sheet 23, which is shown separately in FIG. 3 prior to assembly with the mounting sheet 25 and spacer sheet 27, is preferably about 12 inches wide and about 18 inches long. The mounting sheet 25, which is shown separately in FIG. 4 prior to assembly, is preferably about 11 inches wide and 17 inches long, so that upon assembly, the cover sheet 23 overlaps the mounting sheet 25 in both the width and the length. The spacer sheet 27, shown separately in FIG. 5 prior to assembly, is preferably about 11 inches wide and about 8 inches long. The compartmentalized spacer sheet 27*a* shown separately in FIG. 6 is preferably about 11 inches wide and 15 inches long.

The cover sheet 23 has a top cover sheet edge 31, a bottom cover sheet edge 33 with the cover sheet length therebetween, and left and right side cover sheet edges 35 and 37 respectively with the cover sheet width therebetween. The cover sheet 23 has a cover sheet fold 39 therein about half-way between, and substantially parallel to, the top and bottom cover sheet edges 31 and 33. The cover sheet 23 may be cut from a sheet of a single material, but as shown in FIGS. 1, 2 and 3, is preferably made of a composite structure including a flexible decorative outer layer 41 and a flexible puncture-resistant inner layer 43 suitably attached to the decorative layer 41. The outer layer may be made, for example, of leather, a natural fabric such as velvet, a solid synthetic material, or a woven synthetic material. The puncture-resistant inner layer 43 may be made, for example, of a tightly-woven fabric, or of a tightly packed fibrous material such as felt. The inner layer 43 should resist puncturing by the parts of the earrings mounted on the mounting sheet 25 and provides substantial protection from damage to earrings stored in novel showcase 21. The cover sheet 23 preferably has a stiffener 45 integral therewith and extending adjacent to the top cover sheet edge 31 over substantially the entire width of the cover sheet. As shown in FIGS. 2 and 3, the stiffener 45 is a metal wire or rod. The stiffener 45 may also be a stiff fabric, such as a buckram, which may be sewn or sealed to the cover sheet.

The cover sheet 23 can also have a flexible hanger strap 47 attached, preferably by stitching, at the ends thereof to the cover sheet 23 adjacent to the top cover sheet edge 31 and adjacent to the side cover sheet edges 35 and 37. The strap 47 may be made of any strong material and preferably should aesthetically match the decorative outer layer 41.

The cover sheet 23 also has one closure portion 51 preferably of a first hook-and-loop (VELCRO) closure pair attached adjacent to the top cover sheet edge 31, one closure portion 53 of a second hook and loop (VELCRO) closure pair adjacent to the cover sheet corner between the top edge 31 and the left side cover sheet edge 35, and one closure portion 55 of a third hook-and-loop (VELCRO) closure pair adjacent to the cover sheet corner between the top edge 31 and the right side cover sheet edge 37. As shown in FIGS. 2 and 3, these three closure portions 51, 53 and 55 can be integrated into a single VELCRO strip which is sewn or sealed to the cover sheet 23.

The cover sheet 23 also has the other closure portion 57 of the second hook-and-loop closure pair attached adjacent to the cover sheet corner between the bottom cover sheet edge 33 and the left side cover sheet edge 35, and has the other closure portion 59 of the third hook-and-loop closure pair attached adjacent to the cover sheet corner between the bottom cover sheet edge 33 and the right side cover sheet edge 37.

The mounting sheet 25 has a top mounting sheet edge 61, a bottom mounting sheet edge 63 with the mounting sheet length therebetween; and left and right side mounting sheet edges 65 and 67 respectively with the mounting sheet width therebetween. The mounting sheet has a mounting sheet fold 69 therein about half-way between and substantially parallel to the top and bottom mounting sheet edges 61 and 63. Each of the mounting sheet corners is truncated at about a 45° angle, as shown in FIGS. 2 and 4, so that it does not interfere with the closure portions 53, 55, 57 and 59 of the second and third closure pairs. The mounting sheet 25 has the other hook-and-loop closure portion 71 of the first closure pair attached to the back side thereof (phantom lines in FIG. 4), so as to be positioned opposite the closure portion 51 on the cover sheet 23. The closure portion 71 is in the form of a strip parallel and adjacent to the top mounting sheet edge 61 and extending most of the width between the truncated corners of the mounting sheet 25.

The mounting sheet 25 has an array of holes 73 therein of such size as to be capable of receiving and holding the posts of post-type earrings therein The holes 73 may be in any order, array or arrangement that may be desired. The mounting sheet 25 may alternatively be made of a relatively stiff but flexible mesh which has the holes therein in an a regular array (mounting sheet 25*a* in FIG. 7). Or, the mounting sheet 25 may be made of a flexible solid sheet into which holes or perforations have been formed in a desired arrangement.

The spacer sheet 27 has a top spacer sheet edge 81, a bottom spacer sheet edge 83 with the spacer sheet length therebetween; and left and right side spacer sheet edges 85 and 87 respectively with the spacer sheet width therebetween. The spacer sheet 27 has a spacer sheet fold 89 therein adjacent to the top spacer sheet edge 81 and substantially parallel to the top and bottom spacer sheet edges 81 and 83. Each of the bottom spacer sheet corners is truncated at about a 45° angle as shown in FIGS. 2 and 5, so that the spacer sheet 27 does not interfere with the closure portions 53, 55, 57 and 59 of the second and third closure pairs.

The spacer sheet 27 is of a material that resists puncturing by the parts of the earrings mounted on the mounting sheet 25 and provides substantial protection from damage to earrings stored in the novel showcase 21. A tightly packed fibrous material, such as a felt, is preferred. Also, a composite of many fabric layers sewn together can be used. However, sheet foam cut to size is not desirable as it deteriorates rapidly from manual handling.

Figure 7:
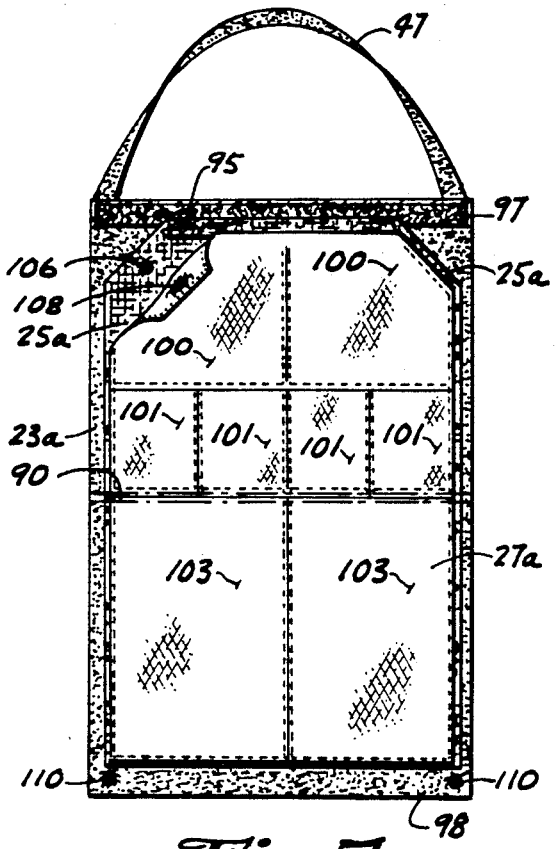
FIG. 7 is a plan view of an assembled alternative travel/display case.

As seen in FIG. 2, the three sheets 23, 25 and 27 are assembled by placing the folds 39, 69 and 89 in the desired order and orientation and then sewing them together as by stitching 29. As shown in FIGS. 2 and 7, the spacer sheet 27 is sewn face down against the mounting sheet 25 so that the spacer sheet 27 bends over the stitching 29.

FIG. 2 shows the novel showcase supported on its strap 47 with a first earring pair 91 and a second earring pair 93 mounted therein above the stitching 29. The earring pairs 91 and 93 are mounted by manually pulling apart the portions 51 and 71 of the first closure pair and inserting the respective posts of the earrings into the holes 73 on the mounting sheet 25. The earring locks are replaced on the earring posts. The portions 51 and 71 of the first closure pair are pressed together to secure the mounting sheet 25 to the cover sheet 23. The earrings 91 and 93 may be removed form the mounting sheet by a similar, reversed procedure.

Earrings (not shown) may be mounted in or removed from the mounting sheet 25 below the stitching 29 simply by raising the spacer sheet 27 and mounting sheet 25 manually and then inserting or removing the earring parts as desired. Closure means 84, 86 (FIG. 2), such as a hook and loop fastener, may be provided as at corners of the bottom edge 83 of the spacer sheet 27 and are adapted to engage cooperating hook and loop fasteners 80, 82 adjacent to the top edge 61 of the mounting sheet 25. The fasteners 80, 82, 84, 86 will hold the spacer sheet 27 in the upright position against the mounting sheet 25 so that earrings mounted to a lower portion of the mounting sheet 25 may be viewed and reached.

To close the showcase 21, the spacer sheet 27 is manually held against the lower portion of the mounting sheet 25 and the lower portion of the cover sheet 23 in the relative positions shown in FIG. 2, and the lower portions of the three sheets are rotated about the stitching 29 so that the bottom cover sheet edge 33 is opposite the top cover sheet edge 31. Then the closure portions 53 and 57 respectively, and 55 and 59 are pressed together as shown in FIG. 1. The showcase 21 can be opened by reversing this procedure.

An alternative embodiment is shown in FIGS. 6–7, wherein like numbers refer to the like elements. The hangable travel showcase for post-type earrings comprises a flexible cover sheet 23*a* having a top cover sheet edge and a bottom cover sheet edge defining a cover length therebetween; cover sheet side edges define a cover sheet width therebetween. A protective cover sheet lining 98 can also be provided. The cover sheet 23*a*, as previously described, has a cover sheet fold about half way between and substantially parallel to the top and bottom cover sheet edges. A flexible, perforated mounting sheet 25*a* is made of a mesh material that is adapted for receiving and holding the posts of post-type earrings. The mounting sheet 25*a* has a top mounting sheet edge and a bottom mounting sheet edge defining a mounting sheet length, and side mounting sheet edges defining a mounting sheet width therebetween. The mounting sheet has a mounting sheet fold therein about half way between and substantially parallel to the top and bottom mounting sheet edges. The mounting sheet width and length are substantially equal to the width and length, respectively, of the cover sheet 23*a*. At least one portion of the mounting sheet top edge is removed to expose an opposing portion of the cover sheet top edge.

A compartmentalized, flexible, spacer sheet 27*a* has two layers and forms a plurality of sealable compartments 100, 101, 103 between the layers, in any desired arrangements of pocket compartments. Each pocket compartment includes closure means 105 along its edges. The closure means 105 may be selected from suitable structure such as cooperating hook-and-loop fasteners. The compartments are sized to store other jewelry items, such as rings in compartments 101, and bracelets and necklaces in compartments 100. Hosiery and other like small items are safely contained in compartments 103. The spacer sheet 27*a* has a top spacer sheet edge 77 and a bottom spacer sheet edge 79 defining a sheet length therebetween. The spacer sheet has a length less than, but substantially the same as the length of the mounting sheet 25*a*. Spacer sheet 27*a* has a spacer sheet fold 90 therein about half way between and substantially parallel to the top and bottom spacer sheet edges.

The mounting sheet fold is superimposed on top cover sheet fold and the spacer sheet fold 90 is superimposed on the mounting sheet fold. The cover sheet 23*a*, mounting sheet 25*a* and spacer sheet 27*a* permanently attached along these superimposed folds by suitable means such as stitching. Cooperating fasteners such as the hook and loop portions 106 at top edge corners of the mounting sheet 25*a*, and portions 108 at inside top edge corners of the spacer sheet 27*a* can be provided to secure the top-half of the spacer sheet 27*a* to the mounting sheet 25*a*.

There are opposing hook-and-loop closure means 95, 97 attached respectively across the width of the mounting sheet 25*a*, adjacent to the top mounting sheet edge, and to the cover sheet 23*a* across the width thereof adjacent to the top cover sheet edge. Preferably closure strip 97 is a common closure strip attached to the cover sheet 23*a* extending substantially across the entire cover sheet width adjacent to the top edge thereof. The travel case top cover sheet edge overlaps said top mounting sheet edge, and the bottom cover sheet edge overlaps the bottom mounting sheet edge. Cooperating hook and loop fasteners 110 can be provided at a bottom corners of the protective lining 98 to engage the closure strip 97 to close the travel case.

Having now illustrated and described my invention, it is not intended that such description limit this invention, but rather that this invention be limited only by reasonable interpretation of the appended claims.

What is claimed is:

1. A travel case for personal accessories including post-type earrings, comprising:

a flexible cover sheet having a top cover sheet edge and a bottom cover sheet edge defining a cover sheet length therebetween; and side cover sheet edges defining a cover sheet width therebetween, said cover sheet having a cover sheet fold therein about half way between and substantially parallel to said top and bottom cover sheet edges;

a flexible, perforated mounting sheet adapted for receiving and holding the posts of said post-type earrings, said mounting sheet having a top mounting sheet edge and a bottom mounting sheet edge defining a mounting sheet length therebetween, and side mounting sheet edges defining a mounting sheet width therebetween, said mounting sheet having a mounting sheet fold therein about half way between and substantially parallel to said top and bottom mounting sheet edges, said mounting sheet width and length being less than or substantially equal to the width and length, respectively, of said cover sheet;

a compartmentalized, flexible, spacer sheet having a plurality of compartments, each of said compartments having a compartment opening, said spacer sheet having a top spacer sheet length therebetween, said spacer sheet length being less than said cover sheet length, and side spacer sheet edges defining a spacer sheet width therebetween, said spacer sheet having a spacer sheet fold therein about half way between and substantially parallel to said top and bottom spacer sheet edges; and, said mounting sheet fold being superimposed on said cover sheet fold and said spacer sheet fold being superimposed on said mounting sheet fold, said cover sheet, mounting sheet and spacer sheet being permanently attached only along said superimposed folds.

2. The travel case according to claim 1, further including opposing closure means attached to said mounting sheet across the width of said mounting sheet, adjacent to said top mounting sheet edge, and to said cover sheet across the width thereof adjacent to said top cover sheet edge.

3. The travel case according to claim 1, wherein said top cover sheet edge overlaps said top mounting sheet edge, and said bottom cover sheet edge overlaps said bottom mounting sheet edge, cooperating closure means being provided at said top cover sheet edge and said bottom cover sheet edge to permit said bottom cover sheet edge to be engaged to said top cover sheet edge to close said travel case.

4. The travel case according to claim 1, wherein said cover sheet has a composite structure including a decorative outer layer and a puncture resistant inner layer adjacent to said mounting sheet.

5. The travel case according to claim 1, wherein portions of said spacer sheet compartments about said compartment openings include closure means.

6. The travel case according to claim 5, wherein said closure means comprises cooperating strips of hook and loop fasteners.

* * * * *